US007278476B1

(12) United States Patent
Burdette

(10) Patent No.: US 7,278,476 B1
(45) Date of Patent: Oct. 9, 2007

(54) RETRIEVABLE STRESS AND TORQUE REDUCING TOOL

(75) Inventor: Charles R. Burdette, Midland, TX (US)

(73) Assignee: Harbison-Fischer, L.P., Crowley, TX (US)

( * ) Notice: Subject to any disclaimer, the term of this patent is extended or adjusted under 35 U.S.C. 154(b) by 0 days.

(21) Appl. No.: 11/409,845

(22) Filed: Apr. 24, 2006

(51) Int. Cl.
*E21B 17/07* (2006.01)
*F04B 53/14* (2006.01)

(52) U.S. Cl. ..... 166/105.2; 166/68; 417/545

(58) Field of Classification Search ..... 166/105.2, 166/68; 267/125; 188/286, 287; 417/545
See application file for complete search history.

(56) References Cited

U.S. PATENT DOCUMENTS 4,963,078 A 10/1990 Agee 6,068,052 A * 5/2000 Dobbs ..... 166/105.2

* cited by examiner

*Primary Examiner*—David Bagnell
*Assistant Examiner*—Giovanna M Collins
(74) *Attorney, Agent, or Firm*—Geoffrey A. Mantooth

(57) ABSTRACT

A stress and torque reducing tool has a plunger that reciprocates inside of a body. The tool is connected between the pump and the sucker rod string and reduces stress transmitted therebetween. The body has upper and lower fluid ports to allow the ingress and egress of well fluids from the body as the plunger reciprocates. If the tool fails, it typically does so by the body breaking into two parts, namely the upper body and lower body, at the upper fluid ports. The upper end of the plunger is provided with a fishing neck. Thus, upon failure of the body at the upper fluid ports, the fishing neck is exposed and can receive a fishing tool for retrieval of the tool and the pump.

10 Claims, 3 Drawing Sheets

RETRIEVABLE STRESS AND TORQUE REDUCING TOOL

FIELD OF THE INVENTION

The present invention relates to apparatuses for reducing stress and torque on downhole equipment.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells and in particular those in fields that are established and aging, natural pressure has declined to the point where the oil must be artificially lifted to the surface. A subsurface pump is located down in the well below the level of the oil. A string of sucker rods extends from the pump up to the surface to a pump jack device, or beam pump unit. A prime mover, such as a gasoline or diesel engine, or an electric motor, or a gas engine, on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing toward the surface.

In the operation of reciprocating the pump, the sudden reversal of movement at the end of the upstroke and the downstroke of the sucker rods imposes reversal strains on the sucker rods as the stretch of the sucker rods is either suddenly released or suddenly imposed upon the rods.

In addition, the subsurface pump used in connection with the sucker rods can undergo what is known as gas lock. This is a condition which occurs when gas enters the compression chamber. The plunger cannot compress the gas to a pressure sufficient to force the traveling valve open. As the plunger is reciprocated, the gas inside the compression chamber is compressed and expanded.

In the prior art, one way to compensate for gas lock is to space the plunger so that it bumps the bottom on every downstroke in order to eliminate gas lock. This action of bumping the bottom causes destructive effects. It increases the stress range on the sucker rods. It causes the rods to go into the compression state each and every time the pump bumps the bottom. It also causes the rods to buckle and slap inside of the tubing, which causes increased wear to the rods, rod couplings and tubing. When the pump bumps bottom it causes the entire weight of the rods to be transferred to the tubing string in a shock load, which can cause premature failure of tubing couplings and threads. Such shock loads are also transferred to the pumping unit when the pump bumps bottom resulting in premature failure of the structural bearings and torque reversals in the gears in the gear box causing excessive wear on the gear teeth and gear box bearing.

Another condition is known as "fluid pound" and occurs in situations where the compression chamber is partially filled with liquid and gas. As the plunger moves on the downstroke through the gas it encounters the interface with the fluid and severely jars the sucker rods in the pump. A similar condition is called a "gas pound" and occurs when the plunger on the downstroke compresses gas to a pressure greater than the rod weight but not sufficient pressure to open the traveling valve. Unintentional gas or fluid pounding in operation of conventional pumps is a common problem in low fluid level wells and marginal producing wells.

U.S. Pat. No. 4,963,078 introduced a stress and torque reducing tool. The stress and torque reducing tool is located between the downhole pump and the sucker rod string and employs a plunger to effectively isolate the sucker rod string from the shock forces of the downhole pump. The plunger is housed in a body, which body has ports located above and below the plunger. The ports allow the entry and exit of well fluid so as to dampen the reciprocal movement of the plunger inside of the body.

While the stress and torque reducing tool of the '078 patent is effective in reducing stress and torque, it suffers from being difficult to retrieve. Due to the severe stresses and torque suffered by the tool, it occasionally fails by breaking. When the tool breaks, it is difficult to retrieve, or "fish" the tool from downhole. This is because there is not enough space to accommodate a fishing tool. The outside diameter of the stress and torque reducing tool is too large relative to the inside diameter of the tubing to allow passage of the fishing tool.

SUMMARY OF THE INVENTION

It is an object of the present invention to provide a stress and torque reducing tool that can be retrieved from downhole after failure.

The apparatus of the present invention is used in coupling a sucker rod string to a downhole pump. The apparatus comprises a hollow body having at least one upper fluid port and at least one lower fluid port. There is an aperture in the lower portion of the body. A plunger is located in the hollow body. The plunger is structured and arranged to reciprocate within the body. The plunger has an upper end portion. A first coupler is attached to the body and structured and arranged to couple to the sucker rod string. A second coupler is attached to the plunger and is structured and arranged to couple to the pump. The plunger upper end portion has a fishing neck.

In accordance with one aspect of the present invention, the fishing neck is located between the upper fluid port and the first coupler.

In accordance with another aspect of the invention, the fishing neck comprises a head and a throat, with the head having an outside diameter that is less than an outside diameter of the plunger.

In accordance with another aspect of the invention, the fishing neck comprises a shank having a smaller diameter than a main body of the plunger.

In accordance with still another aspect of the present invention, there are at least two upper fluid ports.

In accordance with still another aspect, the plunger has a portion with a non-circular transverse cross-section that cooperates with the body so as to limit relative rotational movement between the plunger and the body.

In still another aspect of the present invention, the plunger rotates relative to the body.

DESCRIPTION OF THE PREFERRED EMBODIMENT

Figure 1:
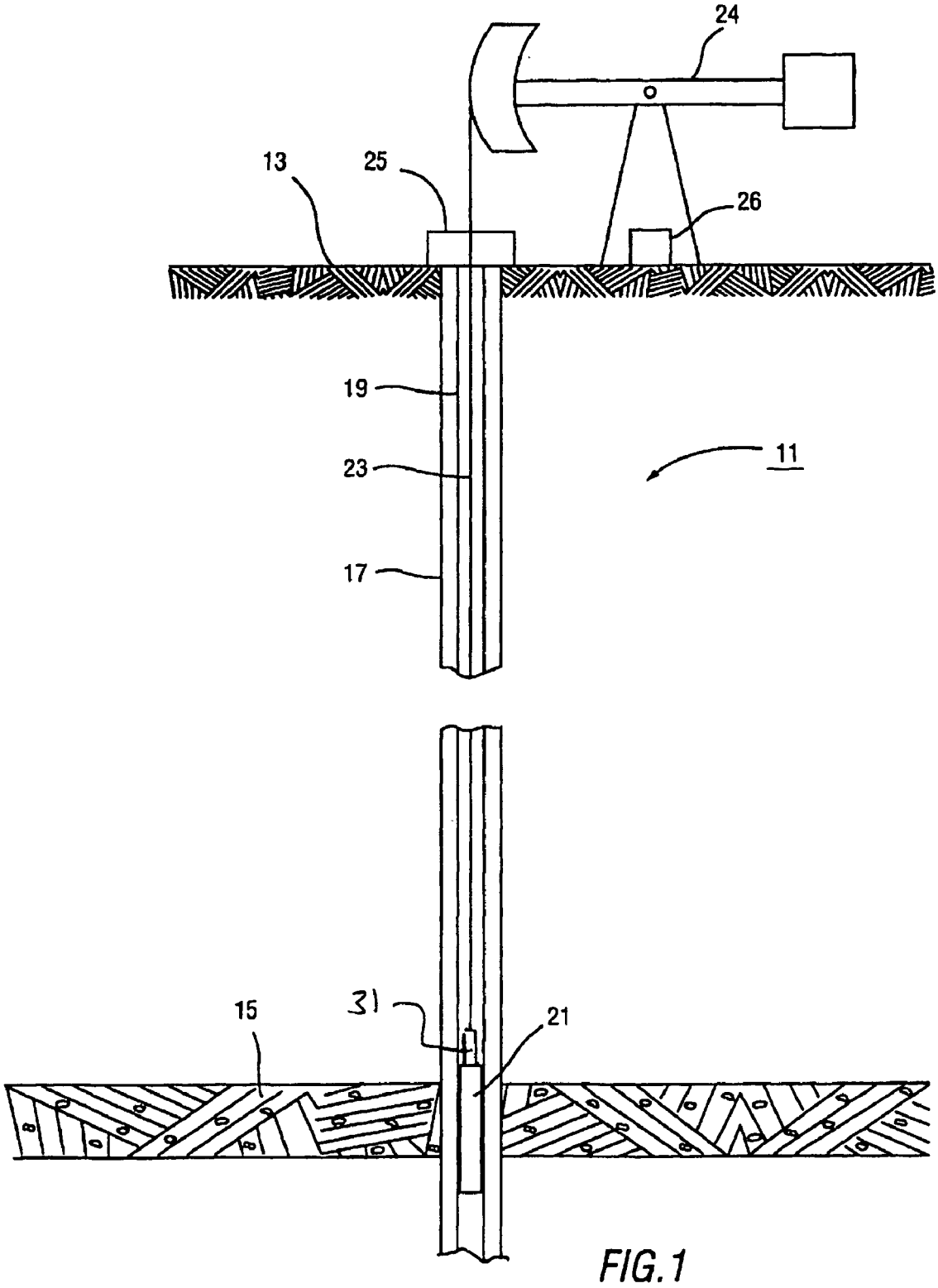
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other device or method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor or gasoline or diesel engine, or gas engine.

The pump 21, which is of the reciprocating type, has a barrel and a plunger. In a fixed barrel pump, the plunger reciprocates and is coupled to the sucker rod string. In a fixed plunger pump, the barrel reciprocates and is coupled to the sucker rod string.

The reciprocating component of the pump, whether it be the plunger or the barrel, is coupled to the sucker rod string by a stress reducing tool 31 of the present invention (STR Tool). The STR Tool 31 provides a plunger 33 (see FIG. 2) that acts as a shock absorber to limit the transmission of shock forces between the pump 21 and the sucker rod string 23, and thus to the surface equipment. The plunger 33 is prevented from rotating so as to limit torque. U.S. Pat. No. 4,963,078 describes the prior art stress and torque reducing tool. The entire disclosure of U.S. Pat. No. 4,963,078 is incorporated herein by reference.

In the description, terms such as "upper", "lower", and so on may be used. These terms are in reference to the orientation of the STR Tool 31 shown in the drawings. The STR Tool can be used in orientations other than what is shown.

Figure 2:
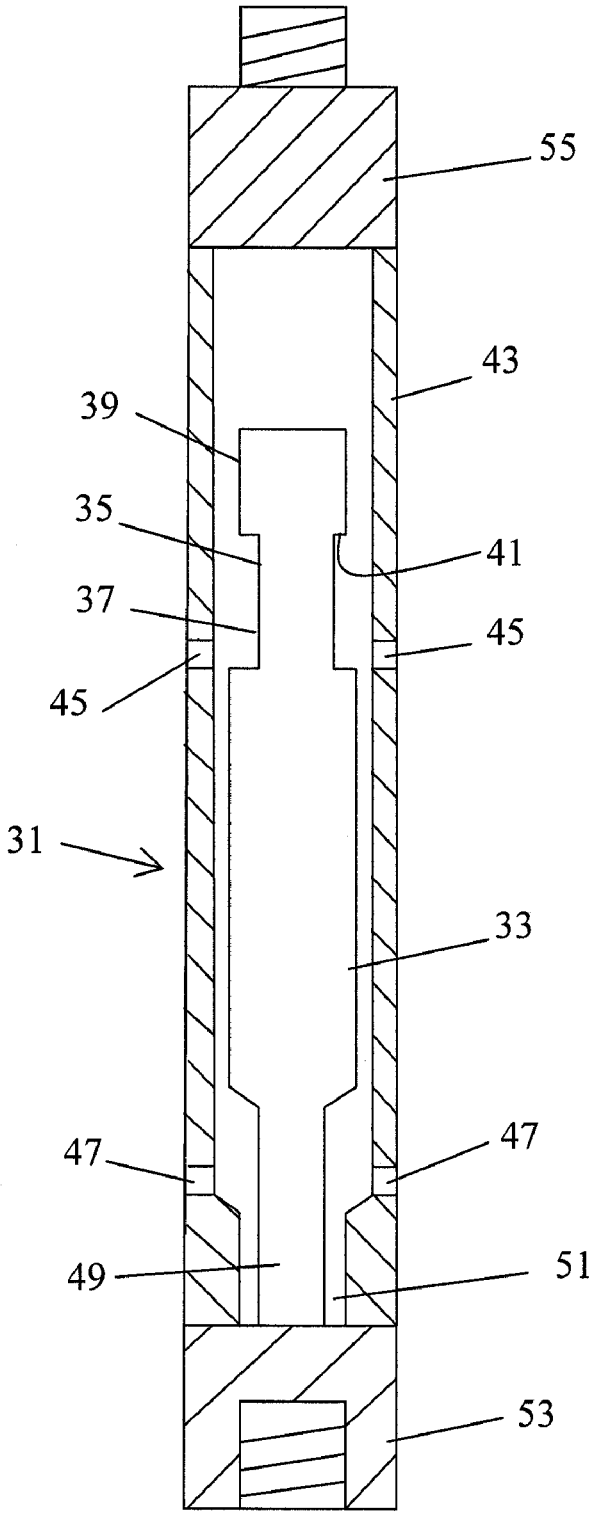
FIG. 2 is a longitudinal cross-sectional view of the stress and torque reducing tool (STR Tool) of the present invention, in accordance with a preferred embodiment.

The present invention modifies the prior art stress and torque reducing tool by providing a fishing neck 35 on the plunger 33, as shown in FIG. 2. The fishing neck 35 is located at the upper end of the plunger 33 and forms an extension in the plunger. The fishing neck 35 has a narrow diameter throat 37 and a large diameter head 39. The head 39 is cylindrical and is slightly smaller in outside diameter than the plunger 33. The head 39 has lower undercut surfaces 41 for a fishing tool to engage.

The body 43 is elongated from the prior art tool in order to accommodate the lengthened plunger 33 and fishing neck 35. The body 43 has upper ports 45 and lower ports 47. The upper ports 45 are positioned below the fishing neck 35.

The plunger 33 has a portion with a noncircular transverse cross-section that cooperates with the body 43 so as to limit relative rotational movement between the plunger and the body. In particular, the plunger 33 has a lower shank 49 that extends through an aperture 51 of the lower end of the body. The shank is noncircular in transverse cross-section. For example, the shank can have a square cross-section. Although in the Figs., the aperture 51 is shown much larger than the shank 49, in the actual tool, the shank 49 cooperates with the noncircular aperture 51 so that the plunger does not rotate relative to the body 43.

A coupler 53 is attached to the lower end of the shank 49; the coupler connects to the pump 21. The upper end of the body 43 is attached to a coupler 55, which in turn connects to the lower end of the sucker rod string 23.

In operation, the plunger 33 moves inside the body 43 forcing well fluid in and out of the upper and lower ports 45, 47. The reciprocal movement of the plunger 33 is dampened by the fluid in the body 43. The STR Tool 31 thus reduces the transmission of shock forces between the pump 21 and the sucker rods 23.

Figure 3:
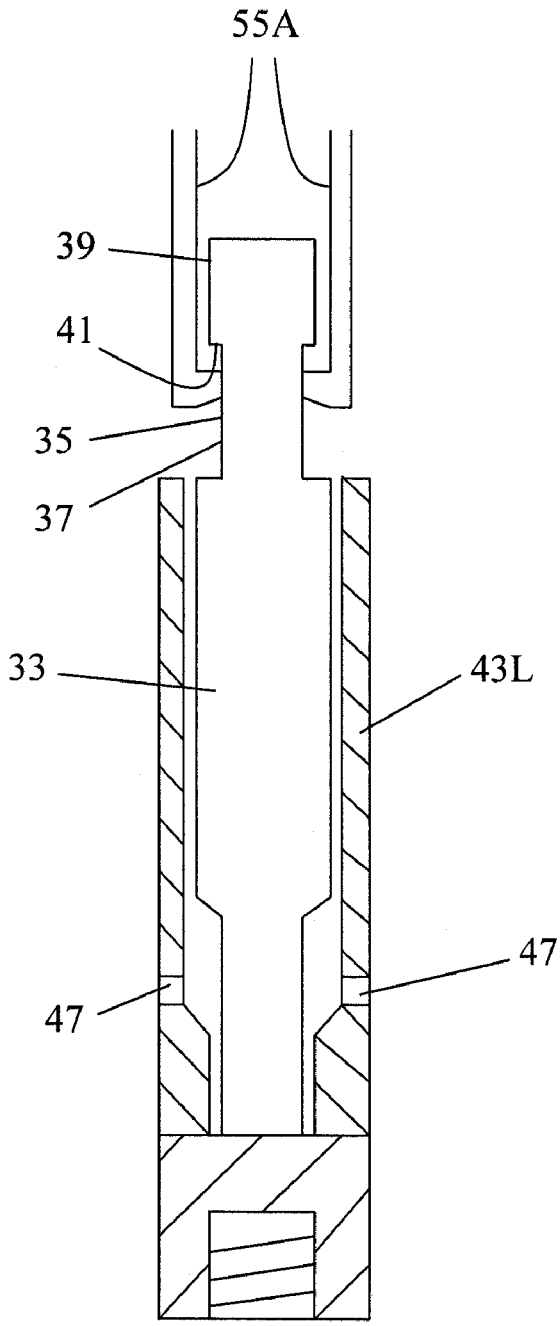
FIG. 3 is a longitudinal cross-sectional view of the STR Tool after failure.

After a period of operation, the STR Tool 31 may fail. When the STR Tool fails, a common failure mode is where the body 43 breaks, or separates, at the upper ports 45, as shown in FIG. 3, forming an upper portion (not shown) and a lower portion 43L. The upper ports apparently are the weakest point of the body 43. When this occurs, the sucker rod string 23, coupler 55 and upper portion of the body 43 are retrieved from the well. The fishing neck 35 is exposed above the lower portion of the body 43L. A fishing tool 55A is lowered into the well so as to grasp on to the fishing neck 35. The fishing tool is able to pass by the head 39 and contact the undercuts 41. The fishing tool is then pulled so as to retrieve the remainder of the STR Tool and the pump from the well.

Thus, the present invention provides a stress and torque retrieving tool that can be retrieved from the well upon failure of the tool.

Although the STR Tool 31 has been described as having a square shank 49 to prevent rotation of the plunger relative to the body, the plunger can rotate relative to the body. For example, the shank 49 can have a circular transverse cross-section and the aperture 51 is also circular. Thus, the plunger 33 can rotate relative to the body 43. Such an arrangement is useful in pumps having rotating plungers. U.S. Pat. No. 5,660,534 describes such a rotating plunger pump. The STR Tool of the present invention would be used as the swivel coupling between the rod and the pump plunger.

Figure 4:
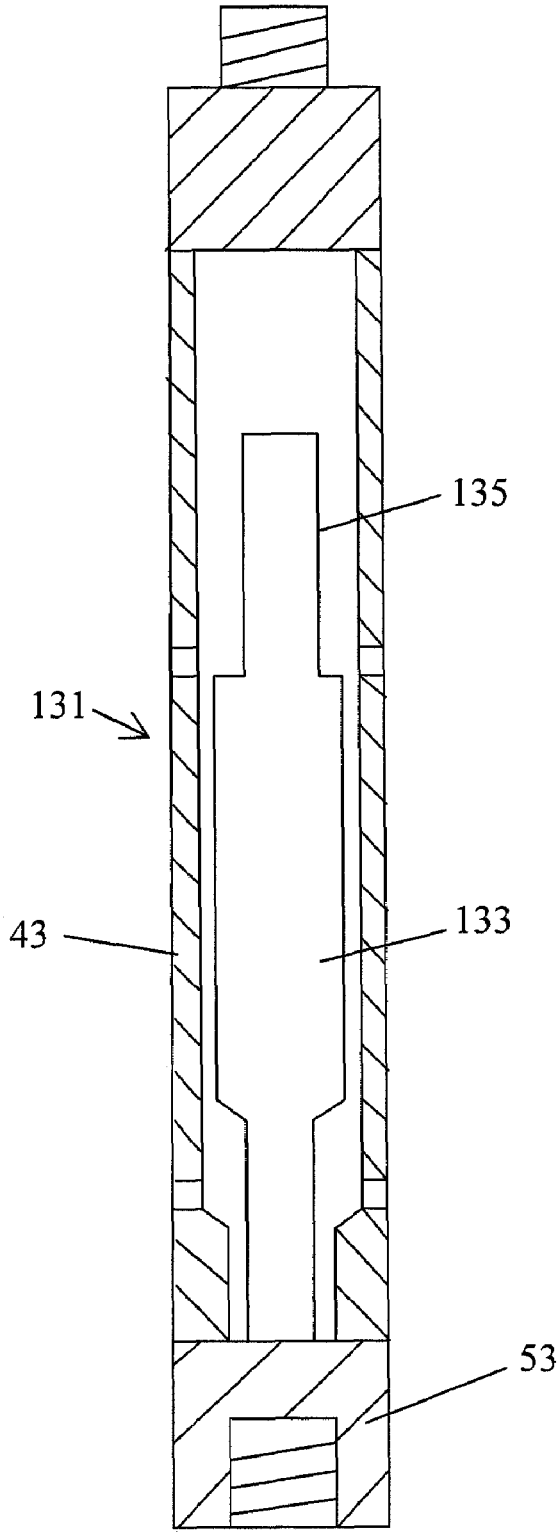
FIG. 4 is a longitudinal cross-sectional view of the STR Tool, in accordance with another embodiment.
Figure 5:
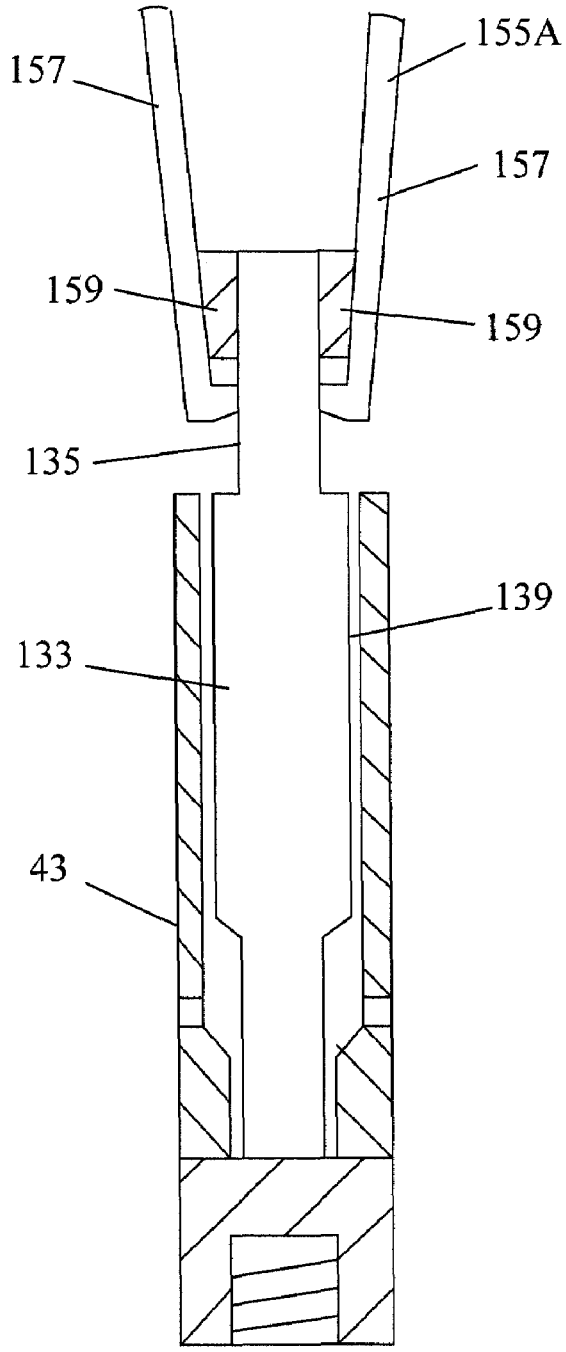
FIG. 5 is a longitudinal cross-sectional view of the STR Tool of FIG. 4, after failure.

FIGS. 4 and 5 illustrate the STR Tool 131 in accordance with another embodiment. The components of the STR Tool 131 are substantially the same as the components of the STR Tool 31 of FIGS. 2 and 3 with the exception of the plunger 133. The upper end of the plunger 133 has a different type of fishing neck 135. The fishing neck 135 is a shank and has no head. The diameter of the fishing neck is less than the diameter of the main body 139 of the plunger. The fishing neck 135, in the preferred embodiment, extends 4-6 inches above the plunger main body.

The fishing neck 135 is structured and arranged to cooperate with a conventional "body" style or overshot fishing tool 155A. The fishing tool has a sleeve 157. Slips 159 move up and down inside the sleeve 157. The inside surfaces of the slips 159, which contact the fishing neck, are provided with teeth. The fishing tool 155A accommodates a range of diameters of stuck objects.

To fish the STR Tool 131, the fishing tool 155A is lowered so that the fishing neck 135 is received into the sleeve 157 and the slips 159. Pulling on the fishing tool 155A wedges the slips 159 between the sleeve 157 and the fishing neck

135, thereby causing the slips to "grab" onto the fishing neck. The STR Tool 131 and the remainder of the pump can then be pulled from the well.

Thus, the fishing neck of the STR Tool can be varied to accommodate various types of fishing or retrieval tools. The two types of fishing necks 35, 135 shown herein are merely illustrative.

The foregoing disclosure and showings made in the drawings are merely illustrative of the principles of this invention and are not to be interpreted in a limiting sense.

The invention claimed is:

1. An apparatus for use in coupling a sucker rod string to a downhole pump, comprising:

a) a hollow body having at least one upper fluid port and at least one lower fluid port;

b) an aperture in a lower portion of the body;

c) a plunger located in the hollow body, the plunger having two ends, the plunger structured and arranged to reciprocate in the body;

d) a first coupler attached to the body and structured and arranged to couple to the sucker rod string, a second coupler attached to one of the ends of the plunger and structured and arranged to couple to the pump;

e) the plunger having a fishing neck, the fishing neck on an opposite end of the plunger from the second coupler.

2. The apparatus of claim 1 wherein the fishing neck comprises a shank having a smaller diameter than a main body of the plunger.

3. The apparatus of claim 1 wherein there are at least two upper fluid ports.

4. The apparatus of claim 1 wherein the plunger has a portion with a noncircular transverse cross-section that cooperates with the body so as to limit relative rotational movement between the plunger and the body.

5. The apparatus of claim 1 wherein the plunger rotates relative to the body.

6. The apparatus of claim 1 wherein the plunger comprises a main body and a shaft that extends from the main body through the aperture to the second coupler, the main body being located between the fishing neck and the shaft.

7. An apparatus for use in coupling a sucker rod string to a downhole pump, comprising:

a) a hollow body having at least one upper fluid port and at least one lower fluid port;

b) an aperture in a lower portion of the body;

c) a plunger located in the hollow body, the plunger structured and arranged to reciprocate in the body, the plunger having an upper end portion;

d) a first coupler attached to the body and structured and arranged to couple to the sucker rod string, a second coupler attached to the plunger and structured and arranged to couple to the pump;

e) the plunger upper end portion having a fishing neck;

f) the fishing neck is located between the upper fluid port and the first coupler.

8. An apparatus for use in coupling a sucker rod string to a downhole pump, comprising:

a) a hollow body having at least one upper fluid port and at least one lower fluid port;

b) an aperture in a lower portion of the body;

c) a plunger located in the hollow body, the plunger structured and arranged to reciprocate in the body, the plunger having an upper end portion;

d) a first coupler attached to the body and structured and arranged to couple to the sucker rod string, a second coupler attached to the plunger and structured and arranged to couple to the pump;

e) the plunger upper end portion having a fishing neck;

f) the fishing neck comprises a head and a throat, the head having an outside diameter that is less than an outside diameter of the plunger.

9. An apparatus for use in coupling a sucker rod string to a downhole pump, comprising:

a) a hollow body having at least one upper fluid port and at least one lower fluid port;

b) an aperture in a lower portion of the body;

c) a plunger located in the hollow body, the plunger structured and arranged to reciprocate in the body, the plunger having an upper end portion;

d) a first coupler attached to the body and structured and arranged to couple to the sucker rod string, a second coupler attached to the plunger and structured and arranged to couple to the pump;

e) the plunger upper end portion having a fishing neck;

f) the fishing neck is located between the upper fluid port and the first coupler;

g) the fishing neck comprises a head and a throat, the head having an outside diameter that is less than the outside diameter of the plunger;

h) there are at least two upper fluid ports.

10. An apparatus for use in coupling a sucker rod string to a downhole pump, comprising:

a) a hollow body having at least one upper fluid port and at least one lower fluid port;

b) an aperture in a lower portion of the body;

c) a plunger located in the hollow body, the plunger structured and arranged to reciprocate in the body, the plunger having an upper end portion;

d) a first coupler attached to the body and structured and arranged to couple to the sucker rod string, a second coupler attached to the plunger and structured and arranged to couple to the pump;

e) the plunger upper end portion having a fishing neck;

f) the fishing neck is located between the upper fluid port and the first coupler;

g) the fishing neck comprises a shank having a smaller diameter than the main body of the plunger;

h) there are at least two upper fluid ports.

* * * * *